United States Patent [19]

Coakley

[11] 4,440,450

[45] Apr. 3, 1984

[54] BOREHOLE MINING VALVE ACTUATION

[75] Inventor: John E. Coakley, Westfield, N.J.

[73] Assignee: Slurry Mining Engineering Inc., Westfield, N.J.

[21] Appl. No.: 409,060

[22] Filed: Aug. 18, 1982

[51] Int. Cl.[3] ..... E21C 45/00

[52] U.S. Cl. ..... 299/17; 175/67; 175/213; 137/119

[58] Field of Search ..... 299/17; 175/67, 213; 137/119

[56] References Cited

U.S. PATENT DOCUMENTS

| | | | |
|---|---|---|---|
| 2,518,591 | 8/1950 | Aston et al. | 299/17 X |
| 3,073,332 | 1/1963 | Strader | 137/119 X |
| 3,155,177 | 11/1964 | Fly | 299/17 |
| 3,316,985 | 5/1967 | Fly | 299/17 |
| 3,730,592 | 5/1973 | Wenneborg et al. | 299/17 |
| 3,747,696 | 7/1973 | Wenneborg et al. | 299/17 |
| 3,951,457 | 4/1976 | Redford | 299/17 X |
| 4,035,023 | 7/1975 | Cockrell | 299/17 |
| 4,059,166 | 11/1977 | Bunnelle | 299/17 |
| 4,067,617 | 1/1978 | Bunnelle | 299/17 |
| 4,077,481 | 3/1978 | Bunnelle | 299/17 |
| 4,077,671 | 3/1978 | Bunnelle | 299/17 |
| 4,344,491 | 7/1982 | Nolan et al. | 299/17 |

FOREIGN PATENT DOCUMENTS

| | | | |
|---|---|---|---|
| 208603 | 10/1956 | Australia | 299/17 |

*Primary Examiner*—Ernest R. Purser
*Attorney, Agent, or Firm*—John E. Coakley

[57] ABSTRACT

A method of drilling and mining a subterranean ore deposit with a tool string having a drill bit and a combined mining nozzle and eductor section with the fluid flow being controlled to each valve by self-activating valves. Controlling the operation of the downhole valves by the pressure of the fluid pumped into the tool string.

An apparatus is provided for actuating down-hole flow control valves in a borehole mining tool to change the tool function from drilling to mining while still in the borehole. Single or double-acting power cylinders are employed as actuators with the system pump pressure applied to one side of the piston while a resilient spring and pneumatic pressure are applied to the other side of the piston. The spring and pneumatic pressure provide sufficient force to maintain the actuator in the drilling mode during the application of drilling pressure while mining system pressure overcomes these forces and actuates the flow control valves.

22 Claims, 2 Drawing Figures

BOREHOLE MINING VALVE ACTUATION

BACKGROUND OF THE INVENTION

1. Field of the Invention

This invention relates to slurry borehole mining and more particularly to a method and apparatus for changing the tool function from drilling to mining without removing the tool from the wellbore.

2. Description of the Prior Art

Hydraulic borehole mining of ore is broadly known in the art as evidenced by the following U.S. Patents:

U.S. Pat. Nos. 3,155,177 and 3,316,985 issued by A. B. Fly on Nov. 3, 1964 and May 2, 1967 respectfully teach a method and apparatus for slurry mining through a borehole which may be changed between its drilling mode of operation and its mining mode of operation without removing the tool from the borehole. The invention teaches the essential controls needed to convert from drilling to mining, i.e., mining nozzle flow, eductor nozzle flow and fluid flow to the drill bit each with a drilling mode and a mining mode of operation. Electric motors within the tool string operate the valves to convert the apparatus from the drilling mode to the mining mode of operation while the tool is still in the borehole.

U.S. Pat. Nos. 3,730,592 issued May 1, 1973 and 3,747,696 issued July 24, 1973 to Wenneborg et al discloses a method and apparatus for borehole mining wherein a hydraulic actuating force for changing the function of the tool from drilling to mining is transmitted from the surface and the actuating fluid line is located wholly within the fluid supply passage to the lower tool section; the hydraulic valve operating means is used to operate the mining nozzle, foot valve and a slurry eductor located at the base of the tool.

U.S. Pat. No. 4,035,023 filed July 15, 1975 and issued July 12, 1977 to Clifford Cockrell discloses a hydraulically operated foot valve which controlls the volume of slurry rising to the surface and is operated by the differential pressure between the vented cavity pressure at the base of the tool and the hydraulic pressure supplied by a slurry level controller.

In this disclosure Cockrell is the first to teach a principle of self-activating down-hole hydraulic valves for tool control; he is first to disclose, describe and use the differential pressure between a control pressure equivalent to or less than system pressure and the vented cavity pressure to establish a hydraulic actuating force for down-hole hydraulic valve control. Cockrell is also first to teach, describe and use the differential hydraulic actuating force between a control pressure and the cavity pressure to modulate down-hole control valves.

U.S. Pat. No. 4,059,166 of Nov. 22, 1977 and No. 4,067,617 of Jan. 10, 1978 issued to P. R. Bunnelle disclose an apparatus for slurry mining wherein several different hydraulic control systems are disclosed to convert the down-hole tool from drilling to mining all with valve control means located within the fluid supply passage to the tool. A control system employing a conduit extending to the surface is used to hydraulically modulate the eductor nozzle to control the cavity pressure control systems activated by the difference between the pump pressure and a vented or cavity pressure are also employed. Self-activating systems to modulate the eductor nozzle also employ the pressure difference between a control pressure and a vented cavity pressure for valve actuation. Seperate control systems are employed for the eductor and the foot valve. An important feature of these systems is that the valve actuating control pressure and the drilling system pressure are the same during drilling while during mining the valve actuating control pressure is established by venting to the cavity pressure or to the atmosphere.

U.S. Pat. No. 4,077,671 of Mar. 7, 1978 and No. 4,077,481 of Mar. 7, 1978 issued to P. R. Bunnelle discloses a modified valve control system which is self-activating by responding to the pressure differential between the system pressure and the pressure in the well cavity. A "vented" control fluid is supplied for selectively opening or closing valves which acts in opposition to the fluid at system pressure on the control means to change the tool function. The salient feature of this method is that during the drilling mode the valve actuating control pressure and the drilling pressure are the same while during mining the valve actuating control pressure is established by venting to the cavity pressure or to the atmosphere.

U.S. Pat. No. 4,344,491 issued Aug. 17, 1982 to J. J. Nolan and J. E. Coakley discloses a valve actuating mechanism actuated by the pressure differential between the drilling system pressure and the mining system pressure. System or pumping pressure is applied to both sides of the piston of a power cylinder with the rod attached to the valve handle. The actuating force being supplied by the differential area of pressure on each side of the piston. The basis for a differential area of pressure being a reduced area on the rod side of the piston which has only the pressure within the discharge conduit acting on the rod extending through the cylinder.

A resilient spring within the cylinder holds the piston in the drilling mode during the application of drilling pressure; the application of mining system pressure forces the piston against the urging of the spring toward and against the stop within the cylinder actuating the valve. An orifice in the tubing connecting each end of the cylinder controls the rate of travel of the piston. The valve actuators use only the pump or system pressure to actuate the valves.

SUMMARY OF THE INVENTION

The first embodiment of this invention provides a combined method of drilling and mining a subterranean ore deposit. The combined apparatus for performing the method comprises a multi-conduit tool string with a drill bit at its base an eductor pump section with a mining nozzle below the eductor and adjacent to the slurry inlet of the tool and with an orifice or valve port at the base of the tool to supply sufficient mining fluid to the drillhead during mining to dislodge accumulations of rocks or debris and wash them upward into the thrust of the mining nozzle to dispose of them in the already mined out area. The tool string is rotated during mining to reduce the ore to a slurry and to clear debris from the suction inlet of the tool. The orifice to supply mining fluid to the borehole base can be presized to supply the fluid or the valve port can be provided with a valve operator to open under mining system pressure.

Prior art tools are prevented from drilling deeper after an initial drilling because of the rocks accumulated at the base of the wellbore.

The present invention also provides an apparatus for actuating downhole flow control valves to change the tool from the drilling mode to the mining mode of operation while the tool is still in the borehole. Pneumatic and spring pressure on one side of a power piston is used to maintain the valves in the drilling mode; the application of mining pump pressure provides the hydraulic actuating force to convert the valve position to the mining mode.

In hydraulic borehole mining the drilling operation is usually carried out using drilling fluid pressures which vary from approximately 200 psig to 400 psig but may be as high as approx. 850 psig. During mining the fluid pressure is increased to approximately 500 psig or higher for specific mining applications. The pressure of the fluid pumped into the tool is also known as the 'system' pressure. It is an object of this invention to provide self-activating valves utilizing the increase in pressure from drilling to mining pressure to activate the valves. Power cylinders consisting of a cylinder with piston and piston rod or rods are used to actuate the valves. The piston rods are attached to the pistons and extend through the cylinder to provide a force to actuate a valve by virtue of the differential pressure across the piston. Valves are equipped with gates or plugs to control the flow therethrough. Valve actuators are mounted with the rod extending from the cylinder to actuate the valve plug. Valve actuators are equipped with ports on each end of the cylinder and provide access to pressurize each side of the piston to actuate the piston. In single acting cylinders the valve ports are on the head end and the rod end of the cylinder.

Our method employes a single or double acting power cylinder as an actuator with a resilient member or spring and a compressible gas, air, or a combination of both on one side of the piston and pump or system pressure imposed on the opposite side of the piston to control the actuation of the valve by variation in the fluid pressure pumped into the tool string. An orifice is installed in the fluid feed port of the cylinder to control the rate of travel of the piston to control water hammer. The piston is held with the valve port in the drilling mode by the spring or resilient member and any air or gas present on that side of the piston. The application of pump or system pressure to the opposite side of the piston forces the piston opposed by the spring and air pressure against a stop on this side of the piston actuating the valve. A stop is installed within a cylinder to control the length of travel of the piston. While a double-acting cylinder is shown in FIG. 1, it will be appreciated that a single-acting cylinder could also be used to actuate a single valve.

In another embodiment of this invention only air or gas pressure is used on one side of the power actuator to hold the valve in the drilling mode; pump or system pressure being applied to the opposite side of the piston. The application of mining system pressure forcing the piston against the air pressure to actuate the valve. Gas or air pressure can be used in the valve control cylinder and the terms are used interchangeably. The pneumatic cylinder port is sealed to retain the air pressure in the cylinder.

In still another embodiment of this invention an accumulator or collecting chamber is employed on the pneumatic side of the piston to collect any fluid that might pass the packings of the piston. A pipe could also be used for this purpose. The chamber or piping can be drained through the casing of the tool string and additional air pressure applied. The chamber also serves to minimize the variations in pressure on this side of the piston.

In yet another embodiment of this invention the pressure drop across an orifice can be used to actuate a power cylinder valve actuator. A resilient spring can be used to hold the valve actuator in the drilling mode during the application of drilling system pressure while the higher pressure drop during the use of mining system pressure is applied to actuate the piston against the spring and fluid pressure. This instance uses hydraulic pressure on both side of the piston, i.e. system pressure on one side and the lower pressure from the orifice tap on the other side. Spring or pressure could also be used on one side of the piston actuator while the lower pressure from the orifice tap could be imposed on the other side to actuate a flow control valve when mining or pump pressure is imposed across the orifice.

It will be understood that hydraulic amplifiers can be employed to vary the actuating pressure to actuate valve controls and that hydraulic oil could be used in the power actuator by employing an oil/water separator or using hydraulic fluid in conjunction with an air chamber.

Foot valves are normally used to control the flow of fluid to the drill bit. Rocks accumulate at the base of the borehole and prevent the resumption of drilling after an initial drilling operation. A valve actuator can be employed on the foot valve to open the foot valve during drilling and close the valve during mining. An additional port can also be employed to supply fluid during mining to agitate the cuttings and rocks at the base of the borehole.

Our method to remove the rocks and debris at the base of the borehole is to have seperate valve actuators for the drilling and mining fluid; drilling would normally be done at 300 psig but the drilling flow control valve would be set to close at 600 psig at the surface and the mining flow control valve would be set to open at 500 psig at the surface. Pumping fluid into the tool string within this pressure range would raise the rocks from the base of the borehole to the mining nozzle area and thrust them into the already mined-out area.

A valve actuator can be employed at the foot valve to open during mining; the valve port being sized for the desired flow rate. The valve actuators can be fabricated to open or close at any desired pressure range and also to have the operating ranges overlap themselves or with the mining flow control valve; separate valve actuators being employed at each port.

These valve actuators can also be employed to control several mining nozzles; the valve actuators can be preset to operate at different pressures or to operate simultaneously.

The self-activating valve operators will actuate the downhole flow control valves without removing the tool string from the borehole. Although the preferred mode has been described, it will be apparent that modifications and variation may be made without departing from what is regarded as the subject matter of this invention.

DETAILED DESCRIPTION OF THE DRAWINGS

Figure 1:
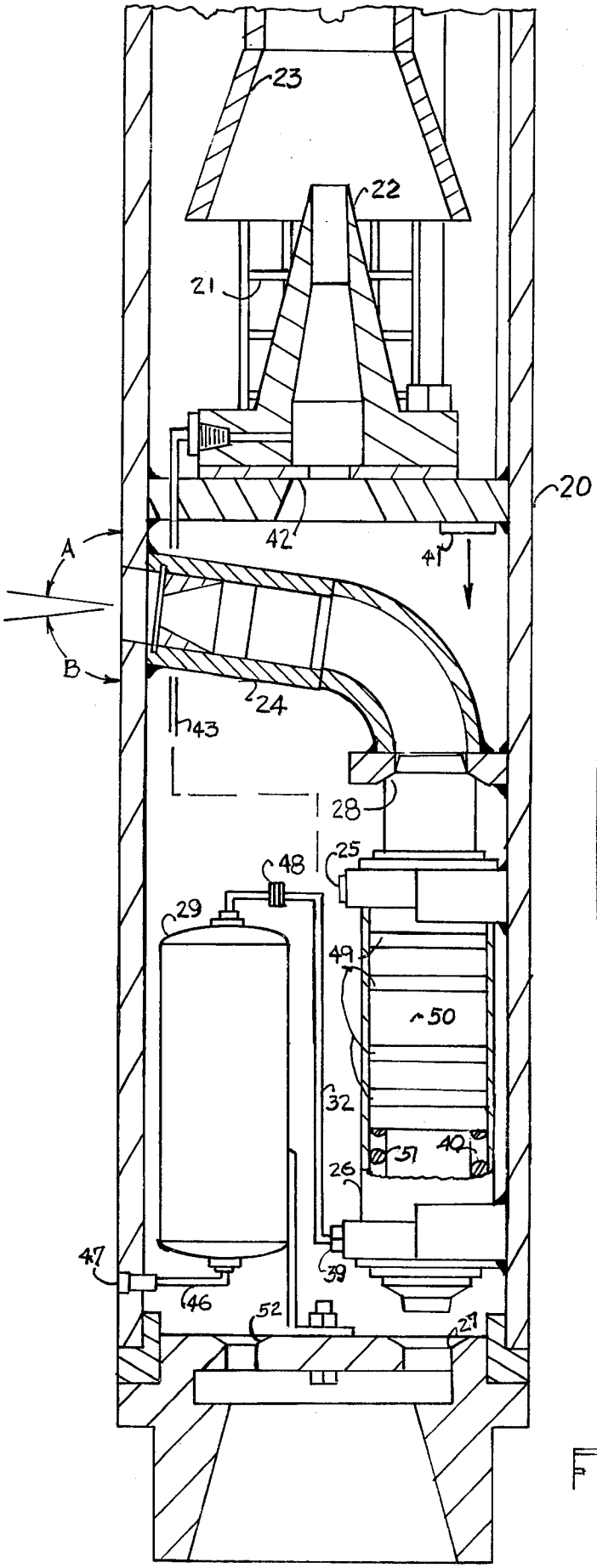
FIG. 1 is a sectional view in elevation of a double-acting power cylinder valve actuator in the drilling mode.

FIG. 1 is a sectional view in elevation depicting a double-acting valve operator in the drilling mode with the drilling port open and the mining port closed. The piston is held with the drilling port open during the application of drilling system pressure through the cylinder port 25 by the spring 51. The application of mining system pressure forces the piston 50 against the spring force to close the drilling port 27 and open the mining port 28. An air chamber 29 is attached to the power cylinder port 39 to collect any small amount of liquid accumulated on the pneumatic side of the power cylinder; the hydraulic side of the piston receives system pumping pressure through port 25. The air receiver 29 can be drained through the drill string casing 20 by opening the valve 47. The system can also be pressurized through the valve port 47. Pumping system pressure, drilling and/or mining, is fed by several conduits into the lower chamber as illustrated by conduit 41. The air chamber 29 and the pneumatic side of the piston 40 can be pressurized through the air valve 47. An orifice 42 is shown installed in the feed line to the eductor nozzle to illustrate an alternate mode of operating the power cylinder using the differential pressure drop between the drilling and mining modes to actuate the piston of the power cylinder; in which case conduit 43 is connected to the piston port 25.

FIG. 1 also shows the mining nozzle below the eductor and adjacent to the slurry inlet to thrust large rocks and clay balls away from the tool inlet. Port opening 52 is used to supply a constant source of water to the drill bit to agitate the rocks and debris at the base of the borehole to force the debris upward into the cavity or into the mining nozzle which propels them into the already mined-out area. A separate control valve can be employed at this port to control the flow of water to the base of the borehole.

FIG. 1 also indicates the mining nozzle displaced at an angle with respect to the axis of the tool string to sculpture the orebed by the mining nozzle; this is of particular value in narrow ore bodies or with slant drilling. All other borehole mining tools have the mining nozzle normal to the axis of the drill string.

Figure 2:
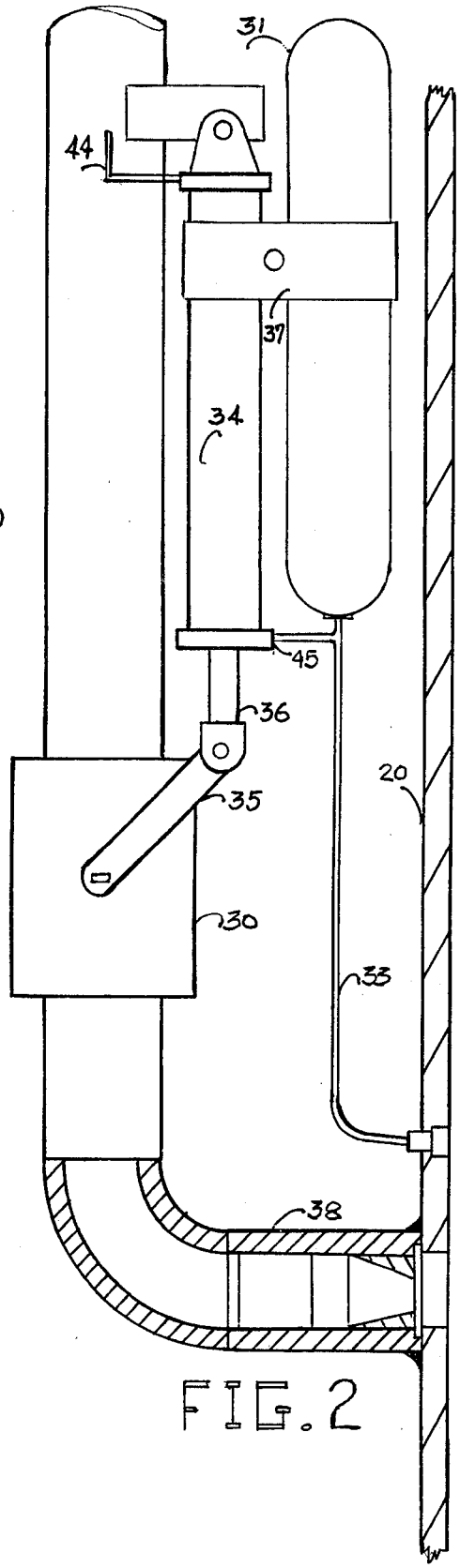
FIG. 2 is a partly sectionalized elevation of a single-acting power cylinder valve actuator.

FIG. 2 is a partly sectionalized elevation of a single-acting power cylinder 34 having hydraulic system pressure applied through line 44 to the upper cylinder while lower pressure air is retained on the rod side of the power cylinder. The piston rod is connected to the valve handle 35 and valve 30. A spring in the rod end of the cylinder is normally employed to hold the cylinder piston at the head end of the cylinder during the application of drilling system pressure although air pressure alone could be used for this purpose. An air chamber 31 is shown connected to the pneumatic side of the piston cylinder actuator. The valve actuator is pivotally mounted to accommodate the arcuate movement of the valve handle; line 33 in actual practice is bent to accommodate this movement. A stop is normally employed on the spring side of the piston to control the piston travel.

DESCRIPTION OF THE PREFERRED EMBODIMENT

Our apparatus for controlling the flow of fluid to the drilling port 27 and the mining nozzle 24 is illustrated in the sectional view in elevation, FIG. 1. A spring 51 is mounted in the annular space 40 between the cylinder and the piston rod to hold the piston raised with the piston rod holding the mining valve port 28 closed and the drilling port 27 open during the application of drilling pressure through the conduit 41 to the upper piston port 25. The space 40 between the cylinder and the piston rod contains a spring 51 and the air entrapped therein during assembly; port 39 being connected through conduit 32 to the air receiver 29. The air chamber 29 has a drain line 46 and valve 47 to drain any water that might pass the piston packing 49.

During the application of mining flow and pressure (500 psig or higher—normally 900 psig) the higher pressure entering the port 25 of the double acting cylinder forces the piston against the spring pressure to close the port 27 feeding drilling water to the drill bit and opens port 28 supplying mining fluid to the mining nozzle to reduce the ore to a slurry. The fluid/ore slurry enters the tool through the grilled entrance 21 and the eductor nozzle 22 forces the slurry through the mixing section 23 and subsequently to the surface through the discharge conduit.

In another embodiment of this invention pneumatic pressure is employed in the cylinder 29 to maintain the piston 50 raised by the application of pneumatic pressure in the space 40 to maintain the valve port 27 open and the mining port 28 closed during the application of drilling fluid pressure to the port 25 of the double-acting cylinder. The application of mining system pressure (500 to 1400 psig or above) to the port 25 via downcommer 41 forces the piston 50 against the lower penumatic pressure at the base of the piston-cylinder actuator to close the valve port 27 stopping the flow of water and opening the port 28 supplying mining fluid to the mining nozzle to reduce the ore to a slurry. It will be appreciated that seperate single-acting valve actuators for the mining nozzle and drilling port can also be employed.

It will be appreciated that a combination of spring and pneumatic pressure could also be employed to hold the drilling port open and the mining port closed during the application of drilling pressure with the mining system pressure functioning to operate the valve actuator. This is our preferred method as we provide a spring capable of holding the valve port during the application of drilling pressure and air pressure (10 psig) to be able to blow out the air chamber of any water.

In still another embodiment of this invention an orifice 42 can be employed to establish a differential pressure with the system pressure wherein the lower pressure is conducted via conduit 43 and connected to conduit 32 to the lower port 39 and space 40 to operate the piston 50 during the application of mining pressure to port 25. A spring in space 40 maintains the valve port 27 open against the differential pressure during drilling, hydraulic pressure being applied to both side of the actuating piston.

It will be further appreciated that the rod areas on each side of the piston can be varied to accommodate a pressure differential during drilling to hold the drilling port open and the mining port closed while system pressure during mining will be sufficient to actuate the valve operator. Single-acting hydraulic-pneumatic power cylinders can actuate downhole flow control valves.

FIG. 2 is a partly sectionalized elevation of a modified form of the hydraulic-pneumatic power cylinder actuator. The actuator is connected to a valve handle and pivotally mounted to accommodate the arcuate movement of the valve handle. A pneumatic accumulator is connected to the rod end 45 of the power cylinder 34. A spring is mounted in the rod end of the cylinder to hold the piston at the head end of the cylinder during drilling while mining system pressure when applied forces the piston toward the rod end actuating the valve.

In a seperate embodiment pneumatic pressure on the rod end can be used to hold the piston at the head end during drilling with mining system pressure forcing the piston toward the rod end actuating the valve. It will be appreciated that a combination of spring and pneumatic pressure could be employed on this type of operator to hold the piston toward the head end of the cylinder during drilling with mining system pressure forcing the piston toward the rod end actuating the valve.

I claim:

1. An apparatus for actuating downhole flow control valves of a borehole mining tool with a power cylinder having a piston actuated by the fluid supply pressure to the tool comprising:

(a) a double-acting power cylinder with a piston within the cylinder and piston rods attached thereto and extending through the ends of the cylinder to operate valve plugs for the drilling water flow valve and for the mining water flow valve, the piston having hydraulic system pressure on one side and pneumatic or gas pressure on the opposite side, the power cylinder having a port at each end of the cylinder communicating with the pneumatic side or the hydraulic side of the piston;

(b) pneumatic or gas pressure within the cylinder on one side of the piston capable of holding the piston at the opposite end when subjecting the hydraulic side of the piston to drilling system pressure;

(c) the pneumatic side port sealed to retain the air or gas within the cylinder:

(d) a piston stop within the pneumatic side of the piston to stop the movement of the piston after a change of valve position;

(e) means of increasing the fluid supply pressure to the mining system pressure and applying the pressure to the hydraulic port side of the power cylinder which forces the piston opposed by the pneumatic pressure on the opposite side of the piston against the stop with the piston rod extensions to the valves closing the drilling port and opening the mining port valve.

2. An apparatus according to claim 1 wherein an orifice is installed in the fluid feed port to the hydraulic side of the piston of the power actuator to control the rate of travel of the piston.

3. An apparatus according to claim 1 wherein a spring is installed within the power cylinder in the pneumatic side capable of holding the piston at the opposite end of the cylinder when subjecting the hydraulic port end of the piston to drilling system pressure.

4. An apparatus according to claim 1 wherein a spring is installed within the power cylinder on the pneumatic side of the piston and air pressure is supplied to the pneumatic side of the piston, the spring and air pressure being capable of holding the piston at the opposite end of the cylinder when subjecting the hydraulic port side of the piston to drilling system pressure.

5. An apparatus according to claim 1 wherein an accumulating chamber is connected to the pneumatic port of the double-acting cylinder to accumulate any fluid and maintain a nearly constant air pressure on this side of the piston.

6. An apparatus according to claim 1 wherein the system pressure during drilling is about 300 psig at the surface and wherein the system pressure during mining is above 500 psig at the surface.

7. An apparatus for actuating downhole flow control valves of a borehole mining tool with a single-acting power cylinder actuator with ports at each end of the cylinder communicating separately with the head end of the piston and the rod end and having the piston rod connected to a valve and actuated by the fluid supply pressure to the mining tool comprising:

(a) a single-acting power cylinder actuator having a piston within the cylinder and a piston rod attached thereto and extending through the end of the cylinder and connected to the valve plug of a flow control valve;

(b) pneumatic pressure within the cylinder at the rod end capable of holding the piston at the head end of the cylinder when subjecting the head end of the cylinder to drilling system pressure;

(c) the rod end cylinder port sealed to retain the air pressure within this section of the cylinder;

(d) means of increasing the fluid supply pressure into the tool and applying this pressure to the head end of the piston which forces the piston opposed by the air pressure on the rod side of the piston toward the rod end of the cylinder operating the valve port connected to the rod.

8. An apparatus according to claim 7 wherein an orifice is installed in the fluid feed port to the hydraulic side of the piston to control the rate of travel of the piston.

9. An apparatus according to claim 7 wherein a spring is installed in the rod end of the cylinder capable of holding the piston at the head end when subjecting the head end of the piston to drilling system pressure.

10. An apparatus according to claim 7 wherein a spring is installed at the rod end of the cylinder and gas pressure is applied to this chamber capable of holding the piston at the head end of the cylinder when subjecting the hydraulic port end of the piston to drilling system pressure.

11. An apparatus according to claim 7 wherein an accumulating chamber is connected to the rod end of the cylinder to accumulate fluid and maintain nearly constant pressure on this side of the piston.

12. An apparatus according to claim 7 wherein the system pressure during drilling is about 300 psig at the surface and wherein the system pressure during mining is above 500 psig at the surface.

13. An apparatus for actuating downhole flow control valves of a borehole mining tool with a power cylinder actuator having a port at each end of the cylinder communicating with the pneumatic side or the hydraulic side of the piston and having the piston rod connected to a valve and actuated by the fluid supply pressure to the mining tool comprising:

(a) a single-acting power cylinder with a piston within the cylinder and a piston rod attached thereto and extending through the end of the cylinder and connected to the valve plug of a flow control valve;

(b) pneumatic pressure within the cylinder at the head end capable of holding the piston at the rod end of the cylinder when subjecting the rod end of the cylinder to drilling pressure;

(c) the head end cylinder port sealed to retain the pneumatic pressure within this section of the cylinder;

(d) means of increasing the fluid supply pressure to the rod end cylinder port which forces the piston opposed by the pressure on the head end of the piston toward the head end of the cylinder operating the valve port connected to the rod.

14. An apparatus according to claim 13 wherein an orifice is installed in the fluid feed port to the rod end of the power cylinder actuator to control the rate of travel of the piston.

15. An apparatus according to claim 13 wherein a spring is installed within the power cylinder at the head end of the piston capable of holding the piston at the rod end when subjecting the rod end of the piston to drilling system pressure.

16. An apparatus according to claim 13 wherein a spring is installed within the head end of the power cylinder and gas pressure is also applied to the head end of the cylinder, the spring and gas pressure being capable of holding the piston at the rod end when subjecting the rod end of the piston to drilling system pressure.

17. An apparatus according to claim 13 wherein an accumulating chamber is connected to the head end port of the power cylinder to accumulated fluid and maintain a nearly constant pressure on this side of the piston.

18. A method of drilling a hole into and mining ore from a subterranean deposit with apparatus including a multi-section tool string having a drill bit at its lower end, pumping mining system fluid through the base of the tool to wash the drill cuttings and accumulated rocks from the base of the borehole, pumping mining system fluid through a mining nozzle adjacent to the slurry inlet of the tool to thrust the rocks and debris into the already mined out area, rotating the tool string during mining to reduce the ore to a slurry and to clear debris from the suction inlet, directing a portion of the fluid through the eductor nozzle to pump the slurry to the surface, selectively controlling the opening and closing of the nozzles and flow control valves while the tool string is in the borehole by controlling the fluid supply pressure to the mining tool.

19. An apparatus according to claim 13 wherein the system pressure during drilling is about 300 psig at the surface and wherein the system pressure during mining is above 500 psig at the surface.

20. An apparatus for actuating downhole flow control valves of a borehole mining tool with a power cylinder actuator having a port at each end of the cylinder communicating with the piston area adjacent to the port and having the piston actuated by the fluid pressure supplied to the tool comprising:

(a) a power cylinder with a piston within the cylinder and a piston rod attached thereto and extending through the end of the cylinder to operate a flow control valve;

(b) an orifice through which fluid at system pressure is directed and having a low-pressure connection on the down-stream side of the orifice;

(c) one power cylinder port connected to pump or system pressure and the opposite port connected to the low pressure side of an orifice and having a spring within the cylinder on this side capable of holding the piston at the opposite end of the cylinder when subjecting the other side of the piston to drilling system pressure;

(d) means of increasing the pressure of the fluid supplied to the tool and applying this pressure to the area of the piston opposite that containing the spring which forces the piston opposed by the spring and the low-pressure fluid from the orifice connection to actuate the piston operating the valve connected to the rod.

21. A method of recovering ore slurry from a subterranean ore deposit through the discharge conduit of a borehole mining tool having the discharge conduit communicating with a slurry inlet located in the side of the casing above the base of the tool and a mining nozzle located adjacent to the slurry inlet by pumping mining system fluid through the mining nozzle to reduce the ore to a slurry and to thrust the rocks and debris into the already mined out area, rotating the tool string during mining and directing fluid through the eductor nozzle to pump the slurry to the surface.

22. A method according to claim 21 wherein a portion of the mining fluid is directed through the tool base to wash the debris from the base of the borehole.

* * * * *